US008967624B1

(12) United States Patent
Ingle

(10) Patent No.: US 8,967,624 B1
(45) Date of Patent: Mar. 3, 2015

(54) RECEPTACLE FOR CATCHING A DISC

(71) Applicant: Thomas L. Ingle, San Pedro, CA (US)

(72) Inventor: Thomas L. Ingle, San Pedro, CA (US)

( * ) Notice: Subject to any disclaimer, the term of this patent is extended or adjusted under 35 U.S.C. 154(b) by 0 days.

(21) Appl. No.: 14/451,084

(22) Filed: Aug. 4, 2014

Related U.S. Application Data

(63) Continuation-in-part of application No. 14/106,196, filed on Dec. 13, 2013.

(51) Int. Cl.
*A63B 63/00* (2006.01)
*A63B 67/00* (2006.01)

(52) U.S. Cl.
USPC ..... 273/400; 473/175; 473/476

(58) Field of Classification Search
USPC ..... 273/398–402; 473/173–176, 179, 180, 473/195, 196, 476–478
See application file for complete search history.

(56) References Cited

U.S. PATENT DOCUMENTS

| | | | | | |
|---|---|---|---|---|---|
| 324,189 | A * | 8/1885 | Thomas | 273/400 |
| 972,597 | A * | 10/1910 | Byl | 273/126 R |
| 979,109 | A * | 12/1910 | Underhill | 273/400 |
| 2,811,358 | A * | 10/1957 | Ruth | 273/348 |
| 3,195,897 | A * | 7/1965 | Labrique | 473/171 |
| 3,403,907 | A * | 10/1968 | Keller | 273/350 |
| 4,204,682 | A * | 5/1980 | Brown | 273/401 |
| 4,337,949 | A * | 7/1982 | Ferris | 473/511 |
| 4,392,653 | A * | 7/1983 | Blume, Sr. | 273/400 |
| 4,717,156 | A * | 1/1988 | Wright | 273/401 |
| 4,982,966 | A * | 1/1991 | Teafatiller | 273/338 |
| 5,040,801 | A * | 8/1991 | Weymuth | 273/338 |
| 5,052,693 | A * | 10/1991 | Hicks | 273/336 |
| 5,060,955 | A * | 10/1991 | Bible | 273/400 |
| 5,110,139 | A * | 5/1992 | Baumgartner | 273/400 |
| 5,190,283 | A * | 3/1993 | Hannon | 473/176 |
| 5,209,493 | A * | 5/1993 | Chernek | 273/400 |
| 5,249,384 | A * | 10/1993 | Dark, Jr. | 40/660 |
| 5,354,067 | A * | 10/1994 | Junemann | 273/400 |
| 5,358,255 | A * | 10/1994 | Jolson | 273/400 |
| 5,382,028 | A * | 1/1995 | Sciandra et al. | 273/401 |
| 5,472,211 | A * | 12/1995 | McCaughan | 273/401 |
| 5,575,483 | A * | 11/1996 | Dineen et al. | 273/317.2 |
| 5,766,086 | A * | 6/1998 | Folsom | 473/185 |
| 6,161,833 | A * | 12/2000 | Gomez | 273/400 |
| 6,367,797 | B1 * | 4/2002 | McKenna-Cress et al. | 273/108.2 |
| 7,500,674 | B2 * | 3/2009 | Riley et al. | 273/400 |
| 2006/0066055 | A1 * | 3/2006 | Menendez | 273/398 |
| 2008/0139343 | A1 * | 6/2008 | Sandman | 473/478 |

* cited by examiner

*Primary Examiner* — Mark Graham
(74) *Attorney, Agent, or Firm* — Hovey Williams LLP

(57) ABSTRACT

A receptacle for receiving a disc thrown in a disc game includes a vertically extending cylindrical sidewall presenting upper and lower portions, an upper edge, a lower edge, an inner surface, an outer surface, and a floor. The inner surface and the floor cooperatively define an open-topped interior chamber configured for receiving and retaining the disc. When the receptacle is installed in the ground surface or an elevated playing surface, the lower portion of the cylindrical sidewall extends approximately 3 to approximately 10 inches below the ground surface or playing surface and the upper portion of the cylindrical sidewall extends approximately 0.125 to approximately 5 inches above the ground surface or playing surface to block and reject discs sliding along the ground surface or playing surface or travelling lower than the upper edge of the cylindrical sidewall.

20 Claims, 6 Drawing Sheets

RECEPTACLE FOR CATCHING A DISC

RELATED APPLICATIONS

The present application is a continuation-in-part patent application and claims priority benefit, with regard to all common subject matter, of earlier-filed U.S. patent application titled "RECEPTACLE FOR CATCHING A DISC," Ser. No. 14/106,196, filed Dec. 13, 2013. The identified earlier-filed application is hereby incorporated by reference in its entirety into the present application.

BACKGROUND

Embodiments of the present invention relate to disc golf courses including receptacles for catching discs. More particularly, embodiments of the invention relate to receptacles for catching and retaining discs that are thrown horizontally or vertically or that are rolled along the playing surface or skipped off of the playing surface or bounced off of the playing surface.

Some disc games require a player to throw a disc towards a target. For example, the game of disc golf is typically played on a disc golf course and comprises a series of holes, each hole comprising a tee area, a fairway area, a number of fairway hazards, a rough area, a green area, and a receptacle for completing the hole. The receptacle for completing the hole in disc golf is typically a chain and basket receptacle positioned on a pole such as the one disclosed in U.S. Pat. No. 4,039,189 issued to Hedrick as the receptacle. The chain and basket assembly on a pole requires the user to throw the disc substantially horizontally through the air for the disc to be caught and retained in its elevated basket. The chain and basket assembly on a pole does not allow the player to complete the disc golf hole by throwing the disc vertically into the basket because the supports for the chains at the top of the assembly interfere with the downward trajectory of the disc. The chain and basket assembly on a pole also does not allow the player to complete the disc golf hole by rolling the disc along the playing surface, skipping the disc off of the playing surface, or bouncing the disc off of the playing surface and into the basket because the basket is mounted on a pole and elevated to approximately 3 feet off of the playing surface.

Accordingly, there is a need for a disc golf course including an improved receptacle for catching a disc that overcomes the limitations described above.

SUMMARY

The present invention solves the above-described problems by providing a disc golf course having an improved receptacle for catching and retaining a disc that is thrown horizontally or vertically, rolled along the playing surface, skipped off of the playing surface, or bounced off of the playing surface.

A receptacle constructed in accordance with an embodiment of the invention broadly comprises a vertically extending sidewall presenting an outer surface, an inner surface, an upper edge, and a lower edge, and a floor connected to the inner surface at an outer edge of the floor. The sidewall and the floor cooperatively define an open-topped interior chamber configured to catch a well thrown disc. The sidewall extends partially below and partially above the playing surface when the receptacle is installed. An upper portion of the sidewall extends above the playing surface so that a disc traveling lower than the upper edge or a disc sliding along the playing surface will be blocked and rejected from the interior chamber by the upper portion of the outer surface of the sidewall but a disc thrown, skipped, bounced, or traveling higher than the upper edge of the cylindrical sidewall can enter into and be retained in the interior chamber or a disc rolling along the playing surface can roll over the upper edge of the sidewall and fall into and be retained in the interior chamber of the receptacle.

The above-described receptacle may be used in a disc golf course having 1, 3, 9, 18, or any other number of disc golf holes. The disc golf course may be laid out on existing terrain, on sculpted and landscaped terrain, or on any other playing surface. Each disc golf hole includes one or more tee areas, a fairway area, a number of fairway hazards, a rough area, a green area, a target hole in the playing surface, and a receptacle.

The tee areas are cleared spaces on the disc golf holes near the beginning or first end of each fairway from which the disc is initially thrown by a disc golf player. The tee areas may have a playing surface of grass but may include dirt, gravel, rocks, sand, wood, metal, rubber, plastic, concrete, or any other natural or man-made material.

The fairway areas are the part of the disc golf holes that extend between the tee areas and the green areas and define a playing surface of grass that is cut shorter than the grass within the rough area and cut longer than the grass within the green area. The fairway area playing surface may also include vegetation, dirt, gravel, pebbles, rocks, sand, wood, metal, plastic, rubber, concrete, or any other natural or man-made material.

Fairway hazards are obstacles that are positioned within the fairway area of the disc golf holes and by which a disc golf player will try to avoid to better maneuver a disc from the initial tee areas towards the green area on each hole. Fairway area hazards may be higher than, lower than, or on the playing surface of the fairway area and may include obstacles such as dirt, sand, pebbles, gravel, rocks, wood, metal, rubber, plastic, concrete, rope, wire, nets, sculptures, structures, ornamental grasses, trees, bushes, hedges, shrubbery, other vegetation, fences, walls, mounds, bunkers, water features, and any other natural or man-made material or object.

The rough area is an obstacle that extends around the borders of the tee areas, the fairway area, and the green area of each disc golf hole and presents features by which a disc golf player will try to avoid to better maneuver a disc from the initial tee areas towards the green areas on each hole. Rough area impediments may be higher than, lower than, or on the playing surface of the rough area. The rough area may be defined by the longest cut of grass of the playing surface of each disc golf hole but may also include obstacles such as dirt, sand, pine needles, pebbles, gravel, rocks, wood, metal, rubber, plastic, concrete, rope, wire, nets, sculptures, structures, ornamental grasses, trees, bushes, hedges, shrubbery, other vegetation, fences, walls, mounds, bunkers, water features, any other natural or man-made material or object, and boundaries.

The green area is the part of a disc golf hole at the second end of the fairway area approximately 18 feet to 1800 feet from the beginning tee areas depending on the size, scope, or scale of the particular disc golf course and depending on the specific size, scope, or scale of the particular discs in use. The green area immediately surrounds the target hole and receptacle on each hole and may define a smooth playing surface of grass that is cut shorter than the bordering grasses of the fairway area and of the rough area. The green area may also have a playing surface of other vegetation, dirt, gravel, pebbles, rocks, sand, wood, metal, rubber, plastic, concrete, and any other natural or man-made material. The green area is a substantially flat surface and may include gradual undulations, different levels, and separations. The target hole is an actual cylindrical hole cut into the playing surface of the green area and receives a receptacle therein.

The target hole is an actual hole cut or dug into the playing surface of the green area and receives a receptacle therein.

A receptacle constructed in accordance with another embodiment comprises a vertically extending cylindrical sidewall configured for placing on a playing surface such that the lower edge of the cylindrical sidewall contacts the playing surface. The cylindrical sidewall and the playing surface define an open-topped interior chamber configured for receiving and retaining a well thrown disc. The cylindrical sidewall extends above the playing surface to discourage a player from sliding the disc along the playing surface and so that a disc traveling lower than the upper edge of the cylindrical sidewall will be rejected from the interior chamber by the outer surface of the cylindrical sidewall but a disc thrown, skipped, bounced, or traveling higher than the upper edge of the cylindrical sidewall can enter into and be retained in the interior chamber or a disc rolling along the playing surface can roll over the upper edge of the cylindrical sidewall and fall into and be retained in the interior chamber of the receptacle.

A receptacle constructed in accordance with another embodiment comprises a vertically extending cylindrical sidewall and a floor connected to a lower edge of the vertically extending cylindrical sidewall for placing on a playing surface such that the floor contacts the playing surface. The cylindrical sidewall and the floor define an open-topped interior chamber configured for receiving and retaining a well thrown disc. The cylindrical sidewall extends above the floor and the playing surface to discourage a player from sliding the disc along the playing surface and so that a disc traveling lower than the upper edge of the cylindrical sidewall will be blocked and rejected from the interior chamber by the outer surface of the cylindrical sidewall but a disc thrown, skipped, bounced, or traveling higher than the upper edge of the cylindrical sidewall can enter into and be retained in the interior chamber or a disc rolling along the playing surface can roll over the upper edge of the cylindrical sidewall and fall into and be retained in the interior chamber of the receptacle.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 8A:
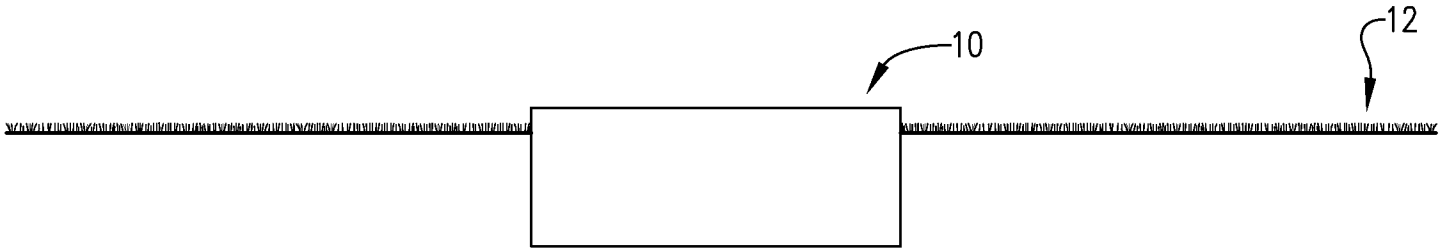
Figure 8B:
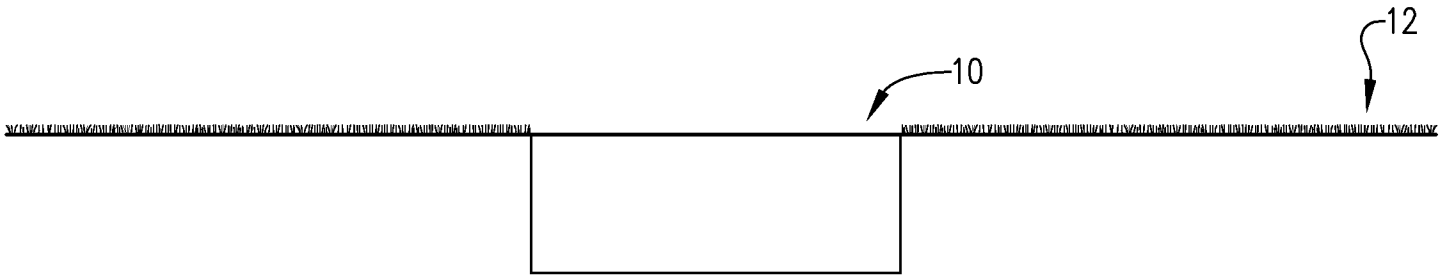
Figure 8C:
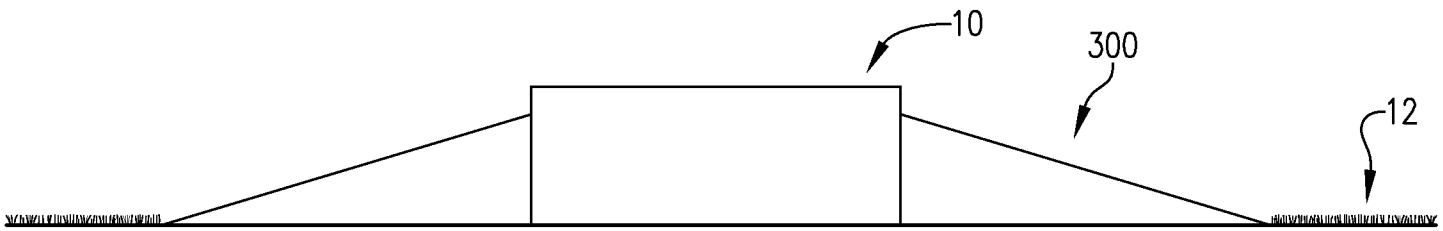
Figure 8D:
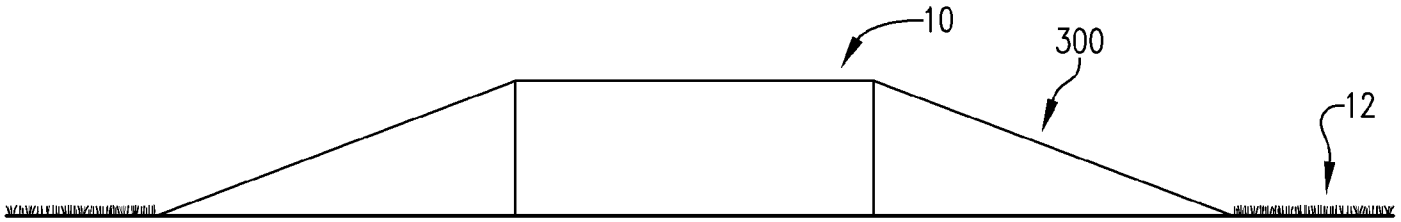
Figure 8E:
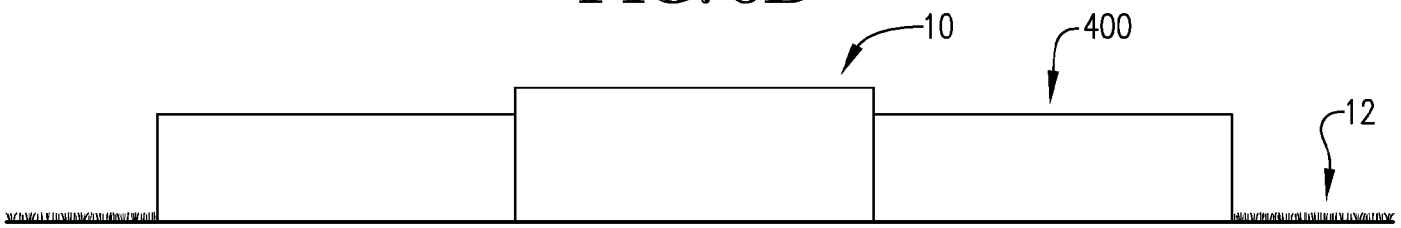
Figure 8F:
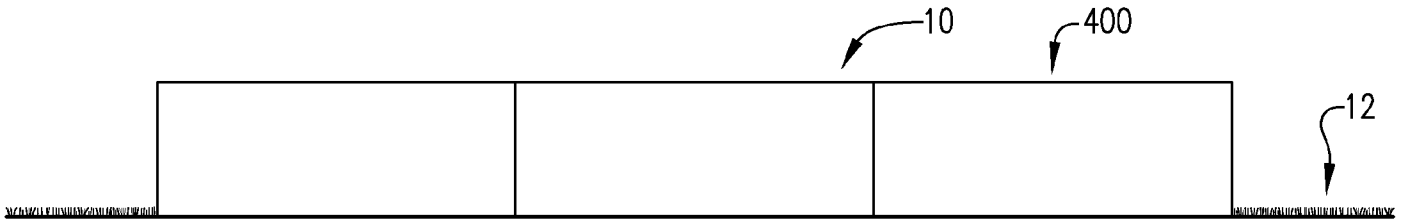
Figure 8G:
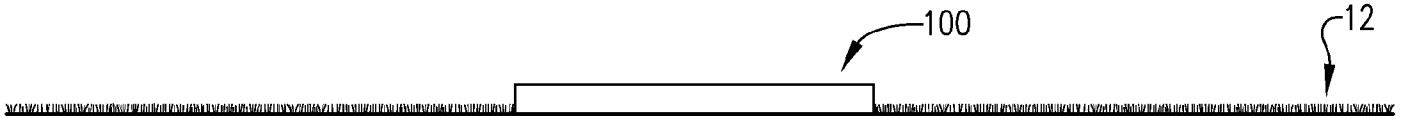

FIG. 8*a* is an elevation view of a receptacle installed in the ground surface of a green area of a disc golf hole with an upper portion of the receptacle extending above the ground surface;

FIG. 8*b* is an elevation view of a receptacle installed in the ground surface of a green area of a disc golf hole with an upper edge of the receptacle being level with the ground surface;

FIG. 8*c* is an elevation view of a receptacle installed above a ground surface of a green area of a disc golf hole with an upper portion of the receptacle extending above a playing surface that is elevated above the ground surface and extends down to the ground surface;

FIG. 8*d* is an elevation view of a receptacle installed above a ground surface of a green area of a disc golf hole with an upper edge of the receptacle being level with a playing surface that is elevated above the ground surface and extends down to the ground surface;

FIG. 8*e* is an elevation view of a receptacle installed above a ground surface of a green area of a disc golf hole with an upper portion of the receptacle extending above a playing surface that is elevated above the ground surface and does not extend down to the ground surface;

FIG. 8*f* is an elevation view of a receptacle installed above a ground surface of a green area of a disc golf hole with an upper edge of the receptacle being level with the playing surface that is elevated above the ground surface and does not extend down to the ground surface;

FIG. 8*g* is an elevation view of a receptacle placed on a playing surface.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Figure 1:
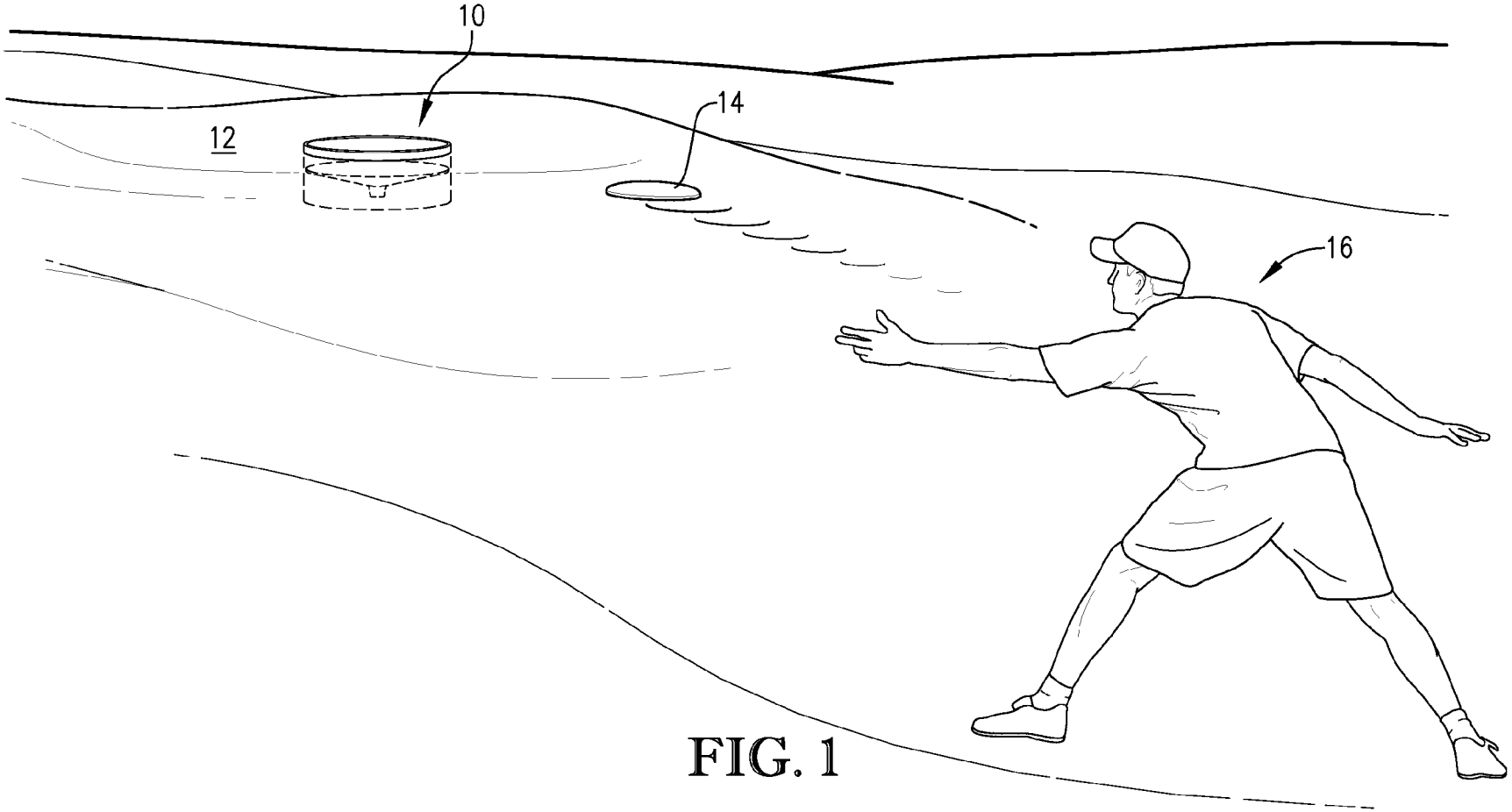
FIG. 1 is a perspective view of a receptacle constructed in accordance with an embodiment of the invention, the receptacle being configured for installation partially below grade.
Figure 2:
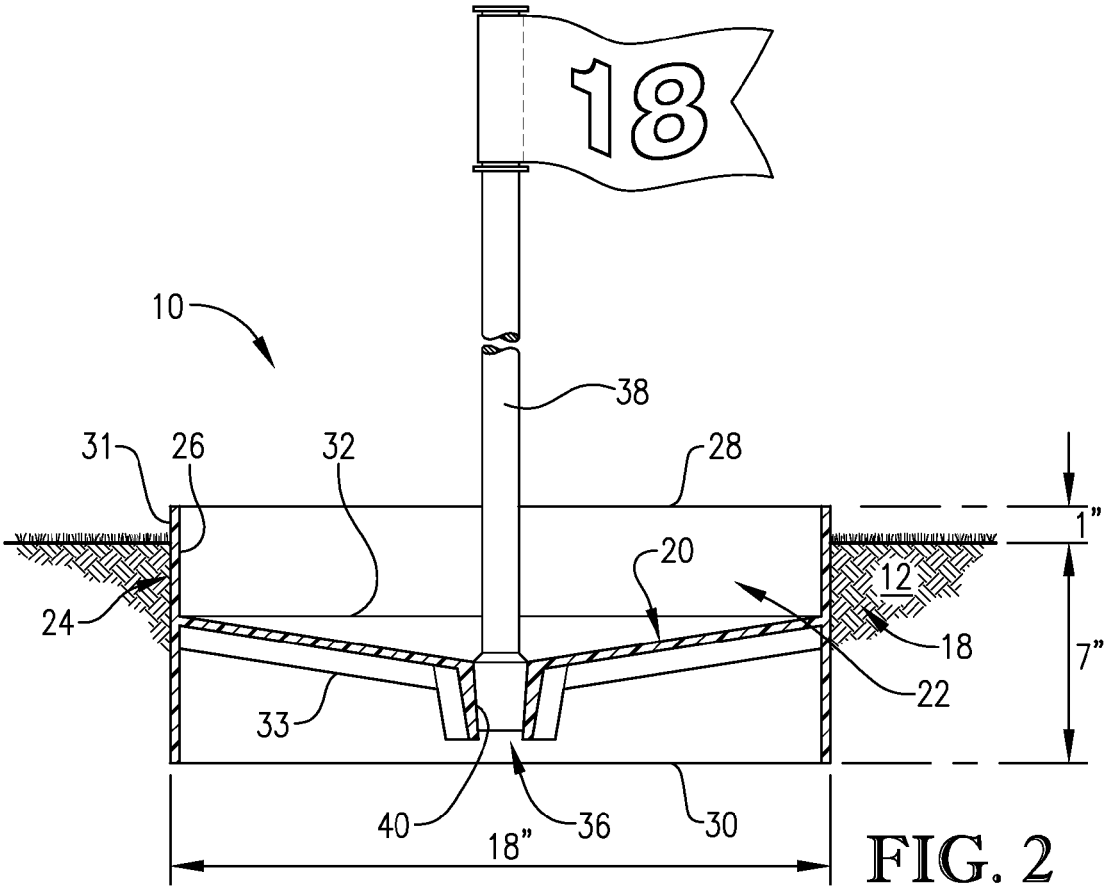
FIG. 2 is a section view of the receptacle of FIG. 1 particularly illustrating the receptacle installed in the playing surface.

Turning now to the drawing figures, and particularly FIGS. 1 and 2, a receptacle 10 constructed in accordance with a first embodiment of the invention is illustrated. The receptacle 10 is configured for installation partially below a ground surface 12 and is configured to catch and retain a well thrown disc 14 thrown by a disc golf player 16. The receptacle 10 broadly includes a vertically extending cylindrical sidewall 18 and a floor 20 for cooperatively defining an open-topped interior chamber 22 configured to receive and retain the disc 14, as described below.

The receptacle 10 may be formed of metal, plastic, rubber, recycled material, composite, or any other material. The receptacle 10 is cylindrical in shape and is installed into the hole in the playing surface and is the finishing goal targeted by players within each green area of each disc golf hole, as described below. The receptacle 10 may be painted or color coded to be easily visible and/or marked with indicia to indicate a hole number (e.g., hole number 9 or 18) or to indicate a hole location or "pin placement" (such as hole location number 1, 2, or 3).

The ground surface 12 may include a layer of grass, other vegetation, dirt, rock, gravel, sand, natural material, man-made material, or a combination of natural material and man-made material. The grass may be between 0.1 inches and 5 inches tall.

The disc 14 may be formed of plastic, rubber, cloth, fiber, paper, wood, metal, or any natural material or any man-made material and may have a diameter of from about 4 inches to about 15 inches. The disc 14 may also be any other known throwing disc such as a Frisbee®. The disc 14 may be thrown horizontally or in a vertical arc through the air, skipped off the ground surface 12, bounced off the ground surface 12, or slid or rolled across the ground surface 12 as discussed in more detail below.

The vertically extending cylindrical sidewall 18 presents an outer surface 24, an inner surface 26, an upper edge 28, and a lower edge 30 (FIG. 2). The cylindrical sidewall 18 is approximately 8 inches to approximately 30 inches in diameter and is configured to be inserted approximately 3 inches to approximately 10 inches into the ground surface 12. The cylindrical sidewall 18 is configured to extend partially above the ground surface 12 when the receptacle 10 is installed, as described below.

The outer surface 24 extends from the upper edge 28 to the lower edge 30 on the outside of the cylindrical sidewall 18 and includes an upper portion 31 that extends approximately 0.125 to approximately 5 inches above the ground surface 12 to the upper edge 28 when the receptacle is installed in the ground surface 12. The upper portion 31 is configured to block or reject the disc 14 from entering the interior chamber 22 if the disc 14 is travelling lower than the upper edge 28 of the cylindrical sidewall 18 or sliding along the ground surface 12.

The inner surface 26 extends from the upper edge 28 to the outer edge 32 of the floor 20 (and may extend to the lower edge 30 of the cylindrical sidewall 18, as shown in FIG. 2) on the inside of the cylindrical sidewall 18 and helps stop and retain a well thrown disc 14 in the interior chamber 22. The upper edge 28 extends around the top circumference of the cylindrical sidewall 18 and is sufficiently low for the disc 14 to fly, skip, bounce, or roll over the cylindrical sidewall 18 and fall into the interior chamber 22.

Figure 3:
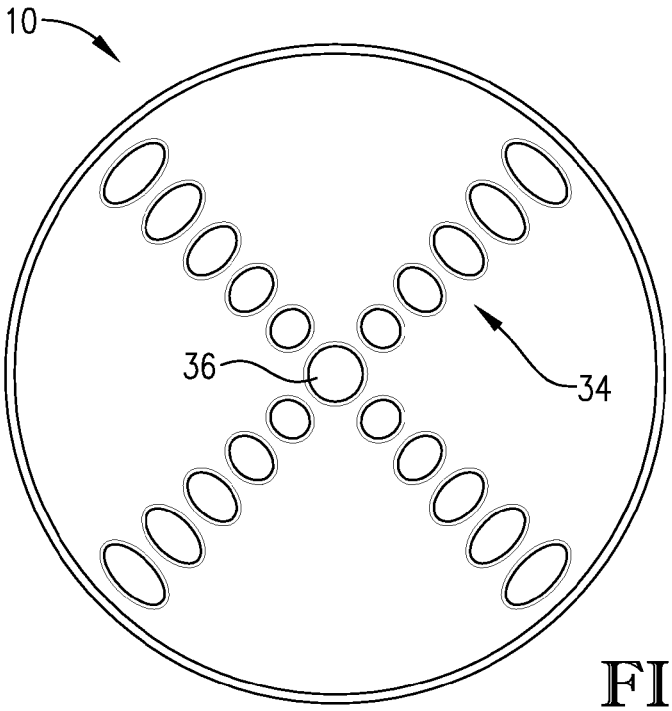
FIG. 3 is a top view of the receptacle of FIG. 1 particularly illustrating radial holes and a central hole in the floor of the receptacle.
Figure 4:
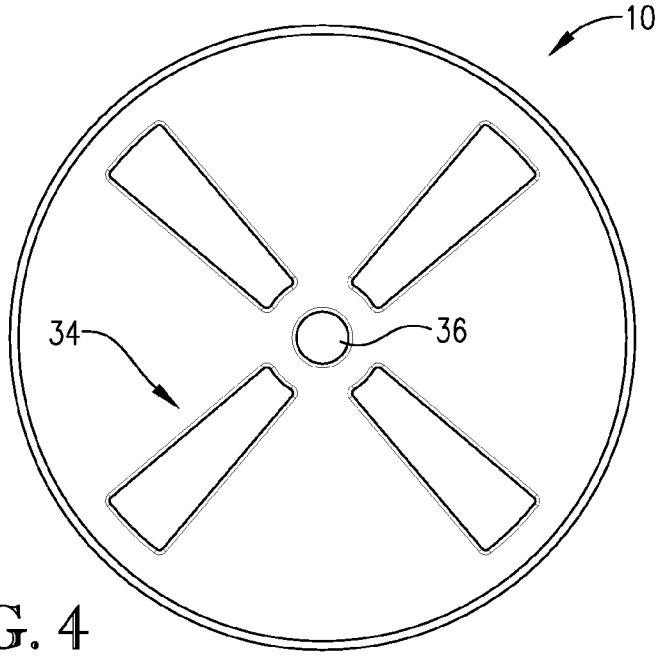
FIG. 4 is a top view of the receptacle of FIG. 1 particularly illustrating an alternative pattern of radial holes.

The floor 20 is connected to the cylindrical sidewall 18 at the outer edge 32 of the floor 20. The floor 20 and the inner surface 26 of the cylindrical sidewall 18 cooperatively define the open-topped interior chamber 22. The floor 20 is reinforced by one or more ribs 33 or other supports and may have a funnel shape (as best shown in FIG. 2), a set of radial holes 34 for draining rainwater from the interior chamber 22, and a central hole 36 for receiving a flagpole 38 therein (as best shown in FIGS. 2-4). The floor 20 may have a slope of approximately 1 inch rise per 8 inches run for effectively removing rainwater.

The radial holes 34 may be randomly or intermittently disposed on the floor 20 or may form a pattern or an array of various parameters such as 2 to 8 columns of 2 to 5 holes each. The columns may be evenly spaced from each other and the radial holes 34 may be evenly spaced from each other within the columns, or the radial holes 34 may be increasingly spaced from each other. The radial holes 34 may be of any size, shape, or pattern, such as each hole in a pattern increasing in one dimension (FIG. 3) or each hole having increasing diameters of $^{9}/_{16}$ inches, $^{10}/_{16}$ inches, $^{11}/_{16}$, $^{12}/_{16}$ inches, and $^{13}/_{16}$ inches from the central-most hole to the outer-most hole. In one particular embodiment, the radial holes 34 form symmetrical quadrilateral shapes radially increasing in width (FIG. 4).

The central hole 36 is provided for receiving the flagpole 38 therein and for draining rainwater (FIGS. 2-4). The central hole 36 is disposed in the middle of the floor 20 and at a bottommost point of the funnel shape. The central hole 36 may be defined by a tapered or slanted wall 40 having an upper diameter of approximately 1 inch for receiving an inverse cone-shaped base of the flagpole 38 (FIG. 2).

The receptacle 10 may alternatively be installed in the ground surface 12 so that the vertically extending cylindrical sidewall 18 extends essentially to the top of the ground surface 12. This configuration is less desirable than the vertically extending cylindrical sidewall 18 extending above the ground surface 12 because in this configuration, the outer surface 24 of the cylindrical sidewall 18 will not block or reject a disc that is slid across the ground surface 12 or thrown low to the ground surface 12.

Figure 7:
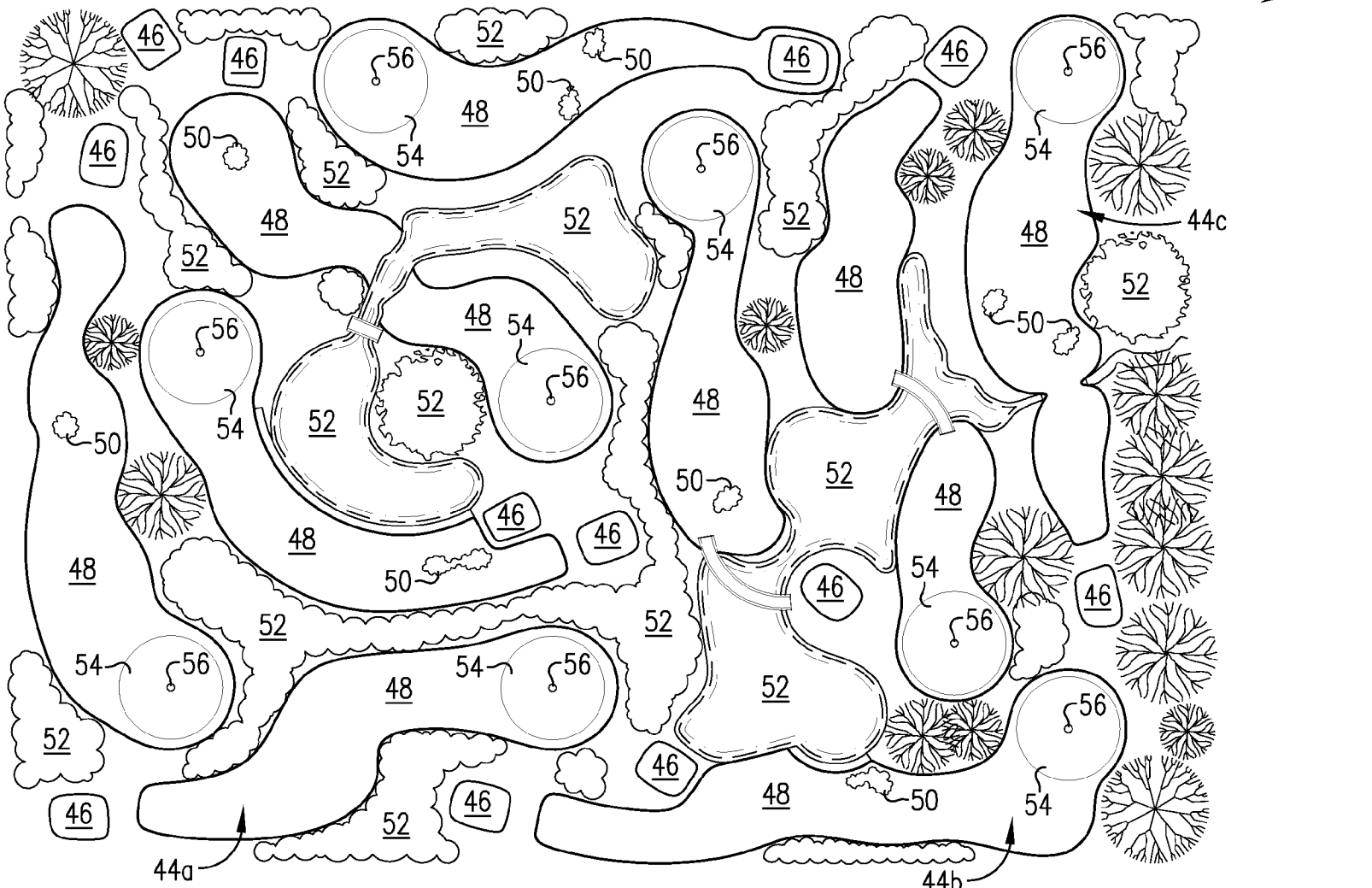
FIG. 7 is a plan view of a disc golf course constructed in accordance with an embodiment of the invention.

The above-described receptacle 10 may be used in a disc golf course 42 having 1, 3, 9, 18, or any other number of disc golf holes of different lengths, elevations, conditions, and variables such as holes 44*a-c*, as shown in FIG. 7. The disc golf course 42 may be laid out on existing terrain, on sculpted and landscaped terrain, or on any suitable playing surface. The disc golf course 42 may be operated by a government entity, resort, hotel, school, club, business, individual, or any organization and may be free, pay-to-play, public, private, or part of an amateur or professional tournament, contest, or tour. Each disc golf hole 44*a-c* includes one or more tee areas 46, a fairway area 48, a number of fairway area hazards 50, a rough area 52, a green area 54, a hole-in-the-playing-surface 56, and a receptacle such as receptacle 10 (as best shown in FIGS. 1 and 2).

The tee areas 46 are the positions where a disc golf player makes an initial throw attempt on each disc golf hole and may include grass, dirt, gravel, rocks, sand, wood, metal, rubber, plastic, concrete, and any other natural or man-made material. The tee areas 46 are positioned at a first end of the fairway area 48. Each tee area 46 may have a color or other designation such as "Professional", "Championship", "Men's", "Women's", "Seniors", "Juniors", and "Beginners", corresponding to a distance from the tee areas 46 to the green area 54 on each disc golf hole.

The fairway area 48 is the optimal position where the disc golf players may attempt subsequent throws if their initial throw from the tee areas 46 do not reach the green area 54 and is usually defined by a playing surface of grass that is cut shorter than the grass within the rough area 52 and cut longer than the grass within the green area 54. The playing surface of the fairway area 48 may include other vegetation, dirt, gravel, pebbles, rocks, sand, wood, metal, rubber, plastic, concrete, and any other natural or man-made material. The fairway area 48 may be bordered by boundaries and numerous obstacles within the rough area 52 so that the path within the fairway area 48 is relatively free of fairway area hazards 50 to provide an optimal route for a disc to travel toward the green area 54.

Within the fairway area 48, there are a number of fairway area hazards 50 to challenge the path of play for a disc golf player. The fairway area hazards 50 within the fairway area 48 may be higher than, lower than, or on the playing surface of the fairway area 48 and may include obstacles such as dirt, sand, pebbles, gravel, rocks, wood, metal, rubber, plastic, concrete, rope, wire, nets, sculptures, structures, ornamental grasses, trees, bushes hedges, shrubbery, other vegetation, fences, walls, mounds, bunkers, water features, and any other natural or man-made material or object.

The rough area 52 surrounds and borders the tee areas 46, the fairway area 48, and the green area 54 and defines the longest cut of grass on a disc golf hole. The playing surface of the rough area 52 may include other vegetation, dirt, gravel, pebbles, rocks, sand, pine needles, wood, metal, rubber, plastic, concrete, and any other natural or man-made material. The rough area 52 may also include a relatively numerous amount of obstacles that provide challenges to the disc golf player's path of play from the tee areas 46 to the green area 54 and may include dirt, sand, pebbles, gravel, rocks, wood, metal, rubber, plastic, concrete, rope, wire, nets, sculptures, structures, ornamental grasses, trees, bushes, hedges, shrubbery, other vegetation, fences, walls, mounds, bunkers, water features, any other natural or man-made material or objects, and boundaries.

The green area 54 is positioned at the finishing or second end of each fairway area 48 and may be approximately 18 feet to 1800 feet from the beginning tee areas 46 depending on the size, scope, and scale of the particular disc golf course and depending on the specific size, scope, or scale of the particular discs 14 in use. The green area 54 immediately surrounds the targeted receptacle 10 and defines a smooth layer of grass on the ground surface 12 (best shown in FIG. 2) that is cut shorter than the bordering grasses of the fairway area 48 and of the rough area 52. The playing surface of the green area 54 may also or instead include other vegetation, dirt, gravel, pebbles, rocks, sand, wood, metal, rubber, plastic, concrete, and any other natural man-made material. The green area 54 is a substantially flat surface and may include gradual undulations, different levels, and separations. The green area 54 allows a disc golf player to throw, skip, bounce, slide, or roll the disc toward the targeted receptacle 10.

The hole-in-the-playing-surface 56 is cylindrical in shape and extends into the ground surface 12 of the green area 54 (best shown in FIG. 2) and receives the receptacle 10 therein. The cylindrical hole-in-the-playing surface 56 is approximately 3 inches to approximately 10 inches deep and approximately 8 inches to approximately 30 inches in diameter depending on the size, scope, or scale of the particular disc golf course 42 and depending on the specific size, scope, or scale of the particular discs 14 in use.

The object of the disc golf game includes players 16 throwing the disc 14 from the tee areas 46 into the receptacle 10 with the fewest number of throws as possible on each disc golf hole 44 or the fewest total cumulative number of throws as possible on a collective number of disc golf holes 44*a-c*.

Play begins with players 16 selecting a disc golf hole 44 within the above-described disc golf course 42. If there is more than one tee area 46 on a given disc golf hole 44, then players select the appropriate tee area 46 on the selected disc golf hole 44 according to their gender or skill level or according to the current course conditions or guidelines of a specific contest, tournament, or tour.

Standing on or within the selected tee area 46, the player 16 will then survey the optimal path from the tee area 46 toward the targeted receptacle 10, select a disc 14 and then make their initial throw of the disc toward the receptacle 10. Longer disc golf holes may require the player 16 to make one or more throws toward the targeted receptacle 10 before being in range to throw the disc into the receptacle 10. If the initial throw of the disc 14 from the tee area 46 is not propelled into the receptacle 10, then the player 16 will make a second throw from where the disc came to rest and so on until the player 16 successfully throws the disc 14 into the receptacle 10 to complete the hole. The player 16 then approaches the tee areas 46 on the next disc golf hole and repeats the above steps until the disc golf course 42 is completed.

The player 16 may propel the disc 14 in a number of ways when playing the above-described disc golf course 42 and any technique of throwing the disc 14 with the player's hand is allowed. For example, the player 16 may flip the disc 14 such that the disc 14 tumbles end over end or the player 16 may fling the disc 14 such that the disc spins around its central axis. The player 16 may flip or fling the disc 14 substantially horizontally or with a vertical arc through the air or roll, skip, or bounce the disc 14 on the playing surface. To complete a disc golf hole the player 16 must propel the disc 14 into the interior chamber 22 of the receptacle 10 by flipping or flinging the disc 14 substantially horizontally or with a vertical arc through the air so that the disc 14 travels over the upper edge 28 of the cylindrical sidewall 18 of the receptacle 10 and into the interior chamber 22. The player 16 may skip the disc off of the ground surface 12, bounce the disc off of the ground surface 12, or roll the disc on the ground surface 12 so that the disc skips, bounces, or rolls over the upper edge 28 of the cylindrical sidewall 18 of the receptacle 10 and falls into the interior chamber 22. The disc 14 will be blocked or rejected from the interior chamber 22 by the upper portion 31 of the outer surface 24 of the cylindrical sidewall 18 when travelling, flying, skipping, bouncing, or sliding lower than the upper edge 28. It will be understood that the player 16 may use a different disc depending on the situation. For example, the player 16 may use a driver disc when throwing from the tee area 46 and a putting disc when throwing from the green area 54.

Figure 5:
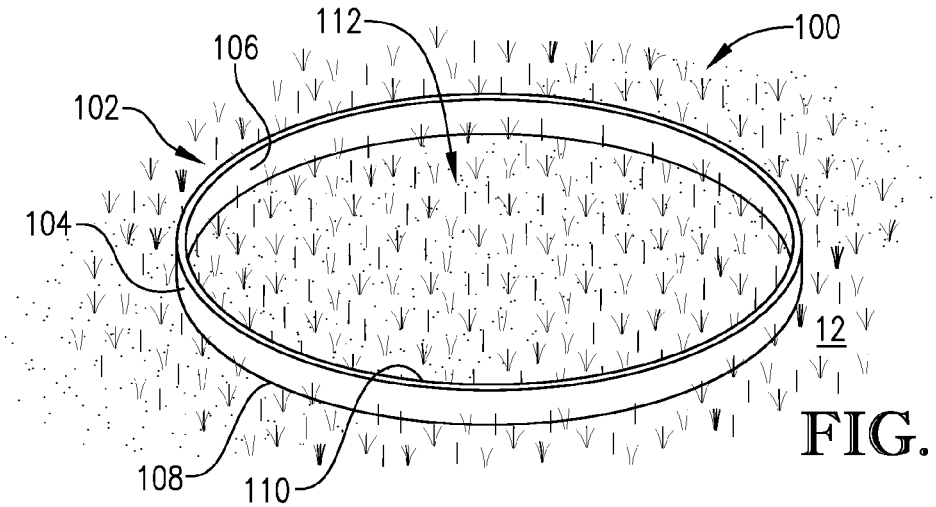
FIG. 5 is a perspective view of a receptacle without a floor and constructed in accordance with another embodiment of the invention, the receptacle being configured for installation above grade.

A receptacle 100 constructed in accordance with another embodiment of the invention is illustrated in FIG. 5. The receptacle 100 is configured to be placed on the ground surface 12 and broadly includes a vertically extending cylindrical sidewall 102 presenting an outer surface 104, an inner surface 106, a lower edge 108 and an upper edge 110. The receptacle 100 may be formed of metal, plastic, rubber, recycled material, composite, or any other material. The receptacle 100 may be painted or color coded to be easily visible and/or marked with indicia to indicate a hole number (e.g., hole number 9 or 18) or to indicate a hole location or "pin placement" (such as hole location number 1, 2, or 3).

The cylindrical sidewall 102 is approximately 8 inches to approximately 30 inches in diameter. The cylindrical sidewall 102 and the ground surface 12 cooperatively define an open-topped interior chamber 112 configured to catch and retain a well thrown disc therein. The outer surface 104 of the cylindrical sidewall 102 extends from the lower edge 108 to the upper edge 110 from approximately 0.125 inches to approximately 5 inches above the ground surface 12 and is configured to block and reject the disc from entering the interior chamber 112 if the disc is travelling lower than the upper edge 110 or sliding along the ground surface 12. The inner surface 106 extends from the upper edge 110 to the lower edge 108 on the inside of the cylindrical sidewall 102 and helps catch and retains a well thrown disc in the interior chamber 112. The lower edge 108 extends around the bottom circumference of the cylindrical sidewall 102 and contacts the ground surface 12. The upper edge 110 extends around the top circumference of the cylindrical sidewall 102 and is sufficiently low for the disc to fly, skip, bounce, or roll over it and fall into the interior chamber 112.

Figure 6:
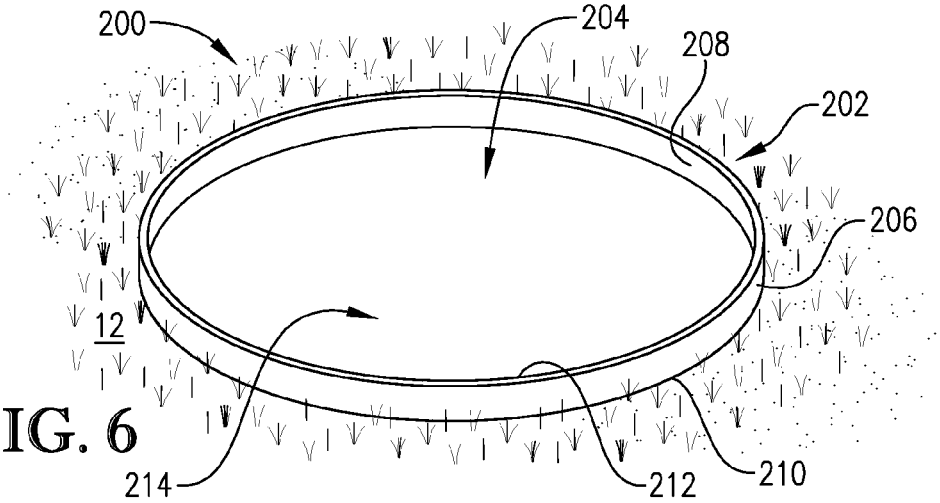
FIG. 6 is a perspective view of a receptacle with a floor and constructed in accordance with another embodiment of the invention, the receptacle being configured for installation above grade.

A receptacle 200 constructed in accordance with another embodiment of the invention is shown in FIG. 6. The receptacle 200 is configured to be placed on the ground surface 12 and broadly includes a vertically extending cylindrical sidewall 202 and a floor 204. The cylindrical sidewall 202 presents an outer surface 206, an inner surface 208, a lower edge 210, and an upper edge 212. The receptacle 200 may be formed of metal, plastic, rubber, recycled material, composite, or any other material. The receptacle 200 may be painted or color coded to be easily visible and/or marked with indicia to indicate a hole number (e.g., hole number 9 or 18) or to indicate a hole location or "pin placement" (such as hole location number 1, 2, or 3).

The cylindrical sidewall 202 is approximately 8 inches to approximately 30 inches in diameter. The cylindrical sidewall 202 and the floor 204 cooperatively define an open-topped interior chamber 214 configured to catch and retain a well thrown disc. The outer surface 206 of the cylindrical sidewall 202 extends from the lower edge 210 to the upper edge 212 from approximately 0.125 inches to approximately 5 inches above the ground surface 12 and is configured to block and reject the disc from entering the interior chamber 214 if the disc is travelling lower than the upper edge 212 or sliding along the ground surface 12. The inner surface 108 extends from the upper edge 212 to the lower edge 210 on the inside of the cylindrical sidewall 202 and helps catch and retains a well thrown disc in the interior chamber 214. The lower edge 210 extends around the bottom circumference of the cylindrical sidewall 202 and contacts the ground surface 12 along with a lower surface of the floor 204. The upper edge 212 extends around the top circumference of the cylindrical sidewall 202 and is sufficiently low for the disc to fly, skip, bounce, or roll over it and fall into the interior chamber 214.

The above-described receptacles may be installed into or on a ground/playing surface or elevated playing surface of the green area in a number of ways, as shown in FIGS. 8*a*-*g*. For example, the receptacle 10 may be installed directly in the ground surface 12 with the upper portion of the receptacle 10 extending above the ground surface 12, as shown in FIG. 8*a*.

The receptacle 10 may be installed in the ground surface 12 with the top edge of the receptacle 10 being level with the ground surface 12, as shown in FIG. 8*b*.

The receptacle 10 may be installed above the ground surface 12 with an upper portion of the receptacle 10 extending above a playing surface 300 that is raised above the ground surface 12, as shown in FIG. 8*c*. The playing surface 300 extends down to the ground surface 12 to form a continuous surface between the playing surface 300 and the rest of the disc golf hole. The playing surface 300 may be formed of any natural or any man-made material and may have an additional layer of grass, other vegetation, dirt, gravel, sand, any natural material, any man-made material, or any combination of natural material and man-made material.

The receptacle 10 may be installed above the ground surface 12 with an upper edge of the receptacle 10 being level with the playing surface 300, as shown in FIG. 8*d*. The playing surface 300 is elevated above the ground surface 12 and extends down to the ground surface 12 to form a continuous surface between the playing surface 300 and the rest of the disc golf hole.

The receptacle 10 may be installed above the ground surface 12 with an upper portion of the receptacle 10 extending above or level with a playing surface 400 that is elevated above the ground surface 12, as shown in FIGS. 8*e* and 8*f*. The playing surface 400 does not extend down to the ground surface 12 so that a gap, step, space, or discontinuous elevation change is formed between the playing surface 400 and the ground surface 12. The playing surface 400 may be formed of any natural or man-made material and may have an additional layer of grass, other vegetation, dirt, gravel, sand, any natural material, any man-made material, or any combination of natural material and man-made material.

The receptacle 100 (or receptacle 200) may be placed on the ground surface 12, as shown in FIG. 8*g*.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A method of playing disc golf, the method comprising:

selecting a disc golf course having one or more disc golf holes, each disc golf hole including a green area having a playing surface and a receptacle for each disc golf hole, each receptacle comprising:

a substantially vertically extending sidewall presenting an upper edge, a lower edge, an inner surface and an outer surface having an upper portion that extends to the upper edge; and a floor connected to the sidewall at an outer edge of the floor, the floor and the inner surface of the sidewall defining an open-topped interior chamber configured for receiving and retaining the disc, the floor having a funnel shape and a plurality of radial holes for draining rainwater from the interior chamber and a central hole for receiving a flagpole therein, a receptacle being installed in the playing surface of the green area of each disc golf hole such that an upper portion of the sidewall of the receptacle extends from approximately 0.125 inches to approximately 5 inches above the playing surface;

attempting a first throw of the disc into the interior chamber of the receptacle of one of the disc golf holes by throwing, skipping, or bouncing the disc higher than the upper edge of the sidewall or rolling the disc along the playing surface and over the upper edge of the sidewall, wherein the disc will be blocked and rejected from the interior chamber by the upper portion of the outer surface of the sidewall when flying lower than the upper edge or sliding along the playing surface; and attempting a second throw of the disc into the interior chamber of the receptacle from the location that the disc landed from the first throw attempt when the disc is not retained in the interior chamber of the receptacle by throwing, skipping, or bouncing the disc higher than the upper edge of the sidewall or rolling the disc along the playing surface and over the upper edge of the sidewall, wherein the disc will be blocked and rejected from the interior chamber by the upper portion of the outer surface of the sidewall when flying lower than the upper edge or sliding along the playing surface.

2. The method of claim 1, wherein the playing surface of the green area is a ground surface.

3. The method of claim 2, wherein the playing surface of the green area includes a layer of grass.

4. The method of claim 3, wherein the layer of grass is less than 1 inch tall.

5. The method of claim 1, wherein the playing surface of the green area is raised above a ground surface.

6. The method of claim 1, wherein the sidewall of the receptacle has a diameter of approximately 8 inches to approximately 30 inches.

7. The method of claim 1, wherein a lower edge of the sidewall of each receptacle is positioned at a depth of approximately 3 inches to approximately 10 inches below the playing surface.

8. The method of claim 1, wherein an upper edge of the sidewall of each receptacle is positioned at a height of 1 inch above the playing surface.

9. The method of claim 3, wherein the layer of grass is approximately 0.1 inches to approximately 5 inches tall.

10. The method of claim 5, wherein the playing surface of the green area includes a man-made material.

11. The method of claim 5, wherein the playing surface of the green area extends down to the ground surface so as to establish a continuation with the ground surface.

12. The method of claim 1, wherein the sidewall of the receptacle has a diameter of 18 inches.

13. The method of claim 1, wherein the sidewall of the receptacle is cylindrical.

14. A method of playing disc golf, the method comprising:

selecting a disc golf course having one or more disc golf holes, each disc golf hole including a green area having a playing surface raised above a ground surface, and a receptacle, each receptacle comprising:

a substantially vertically extending sidewall presenting an upper edge, a lower edge, an inner surface and an outer surface; and a floor connected to the sidewall at an outer edge of the floor, the floor and the inner surface of the sidewall defining an open-topped interior chamber configured for receiving and retaining the disc, a receptacle being installed in the playing surface of the green area of each disc golf hole such that an upper portion of the sidewall of the receptacle extends to the playing surface so that an upper edge of the sidewall of the receptacle is approximately level with the playing surface;

attempting a first throw of the disc into the interior chamber of the receptacle of one of the disc golf holes by throwing, skipping, or bouncing the disc higher than the playing surface or rolling or sliding the disc along the playing surface, wherein the upper portion of the outer surface of the sidewall will not block and reject the disc when the disc is flying above the playing surface or sliding or rolling along the playing surface; and attempting a second throw of the disc into the interior chamber of the receptacle from the location that the disc landed from the first throw attempt when the disc is not retained in the interior chamber of the receptacle by throwing, skipping, or bouncing the disc above the playing surface or rolling or sliding the disc along the playing surface, wherein the upper portion of the outer surface of the sidewall will not block and reject the disc when the disc is flying above the playing surface or sliding or rolling along the playing surface.

15. The method of claim 14, wherein the sidewall of the each receptacle has a diameter of approximately 8 inches to approximately 30 inches.

16. The method of claim 14, wherein the receptacles are installed into the playing surfaces such that a lower edge of the sidewall of each receptacle is positioned at a depth of approximately 3 inches to approximately 10 inches below the playing surface.

17. The method of claim 14, wherein the playing surface of the green area includes a layer of man-made material.

18. The method of claim 14, wherein the playing surface of the green area extends down to the ground surface so as to establish a continuation with the ground surface.

19. The method of claim 14, wherein the receptacles are installed into the playing surface such that a lower edge of the sidewall of each receptacle is positioned at a depth of 7.5 inches below the playing surface.

20. The method of claim 14, wherein the sidewall of the receptacle is cylindrical.

* * * * *